United States Patent [19]

Baltschun

[11] 4,155,300

[45] May 22, 1979

[54] PRESS

[75] Inventor: Horst Baltschun, Rülzheim, Fed. Rep. of Germany

[73] Assignee: SMG Süddeutsche Maschinenbau-Gesellschaft mbH, Fed. Rep. of Germany

[21] Appl. No.: 892,114

[22] Filed: Mar. 31, 1978

[30] Foreign Application Priority Data

Apr. 5, 1977 [DE] Fed. Rep. of Germany ..... 2715188

[51] Int. Cl.[2] ..... B30B 1/08

[52] U.S. Cl. ..... 100/269 R; 100/270

[58] Field of Search ..... 100/257, 270, 269 R; 83/554, 617; 60/698, 709

[56] References Cited

U.S. PATENT DOCUMENTS

| | | | |
|---|---|---|---|
| 905,601 | 12/1908 | Sperber | 100/269 R |
| 3,938,362 | 2/1976 | Falk | 10/257 X |

FOREIGN PATENT DOCUMENTS

| | | | |
|---|---|---|---|
| 1399327 | 7/1975 | United Kingdom | 100/270 |

*Primary Examiner*—Billy J. Wilhite

*Attorney, Agent, or Firm*—Craig and Antonelli

[57] ABSTRACT

A press arrangement which includes a press ram selectively displaceable in a working stroke direction by at least one hydraulically actuated, double-acting cylinder piston unit with an auxiliary drive arrangement being provided for displacing the press ram in an idle stroke preceding a working stroke. The auxiliary drive arrangement bypasses the at least one cylinder piston unit and acts on the press ram. The auxiliary drive arrangement may be constructed as a toothed rack-and-pinion arrangement, a linearly double-acting pressure medium drive, or may include an electric linear motor acting on the press ram.

6 Claims, 3 Drawing Figures

PRESS

The present invention relates to a press arrangement and, more particularly, to a press arrangement having a press ram displaced in a working stroke direction by at least one hydraulically operated, double-acting cylinder piston unit with an auxiliary drive moving or displacing the press ram during an idle stroke preceding a working stroke in the working stroke direction.

In hydraulic presses of the afore-mentioned type such as disclosed, for example, in British Pat. No. 1,399,327 and U.S. Pat. No. 3,938,362 (FIG. 6), during a movement of the press ram along an idle stroke, the auxiliary drive acts on the press ram by way of the cylinder piston unit which, during that period of time, is inoperative and without pressure and which serves to make the following working stroke. On completion of an idle stroke effected by the auxiliary drive, that part of the cylinder piston unit on which the auxiliary drive acts reaches a position in which such part is held fast. Only then does pressure build up in the cylinder piston unit and initiate a working stroke.

One disadvantage of these proposed presses resides in the fact that a certain time interval is required for building up the hydraulic pressure so that it is difficult to operate the press at a relatively high speed.

A further disadvantage of the proposed presses resides in the fact that the auxiliary drive has to move the entire cylinder piston unit in addition to the press ram during an idle stroke and also that the entire reaction forces of the cylinder piston unit must be taken by the auxiliary drive so that the auxiliary drive must be of suitably large dimensions.

The aim underlying the present invention essentially resides in providing a press which permits relatively higher stroke rates.

According to advantageous features of the present invention, the press includes at least one cylinder piston unit with the piston having two operative or effective piston surfaces of equal size with associated cylinder pressure spaces being in selective communication by way of pressure medium conduits or lines which are controlled by a selectively actuable control valve. A pressure medium source is connected to a pressure medium conduit or line disposed between the control valve and the cylinder space associated with the operative or effective piston surface which is acted upon by the pressure medium in a working stroke direction, while another pressure medium conduit or line is relieved of pressure when disconnected by the control valve.

Moreover, according to the present invention, an auxiliary drive is operatively associated with the press ram and the at least one cylinder piston unit such that the auxiliary drive acts upon the press ram bypassing the at least one cylinder piston unit.

According to a further feature of the present invention, the auxiliary drive may be constructed as a rack and drivable pinion arrangement with the idling of the auxiliary drive being achieved through an idling of a motor driving the pinion or by a disconnection of the drive motor from the pinion.

In accordance with yet another feature of the present invention, the auxiliary drive may be constructed as a double-acting pressure medium drive arrangement which includes a double-acting cylinder piston means operatively connected to the press ram. With the double-acting pressure medium drive arrangement, an idling of the auxiliary drive can be achieved by a low friction circulation of pressure medium between the two cylinder pressure spaces of the double-acting cylinder piston means, with any shortage of pressure medium being made up or any excess of pressure medium being discharged.

According to an additional feature of the present invention, the auxiliary drive may be constructed as an electric linear motor directly acting upon the press ram. With an electric linear motor as the auxiliary drive, an idling of the drive can be achieved by switching off the operating voltage of the electric linear motor.

On a charge-over from an idle stroke to a working stroke of the press ram, according to the present invention, the auxiliary drive can either continue to act or be effective in the work stroke direction, or be changed-over to an idling.

Furthermore, by virtue of the provision of a double-acting auxiliary drive, the press may be in the form of a downstroke, upstroke or horizontal stroke press.

In a construction in accordance with the present invention, during an idle stroke, advantageously, the auxiliary drive needs only to move that part of the at least one cylinder piston unit which acts upon the press ram. Moreover, at any point in the total ram stroke consisting of the idle stroke and the working stroke, a transition can be made from the idle stroke to the working stroke without interruption of the movement and without the necessity for any moving parts to be held fast. During this transition, prestressed pressure medium which is under the pressure of the pressure medium source and which, during the preceding idle stroke, was circulated with low resistance from one cylinder space to the other, is available without delay in that cylinder space of the cylinder piston unit which is associated with the pressure medium source acting in the working stroke direction. Furthermore, that part of the cylinder piston unit which does not act on the press ram can be spatially fastened and, accordingly, requires no special guide means and/or retaining means.

Accordingly, it is an object of the present invention to provide a press arrangement which avoids by simple means shortcomings and disadvantages encountered in the prior art.

Another object of the present invention resides in providing a press arrangement which permits relatively high stroke rates.

An additional object of the present invention resides in providing a press arrangement which functions reliably under all operating conditions.

These and other objects, features and advantages of the present invention will become more apparent from the following description when taken in connection with the accompanying drawings which show, for the purposes of illustration only, several embodiments in accordance with the present invention, and wherein.

Figure 1:
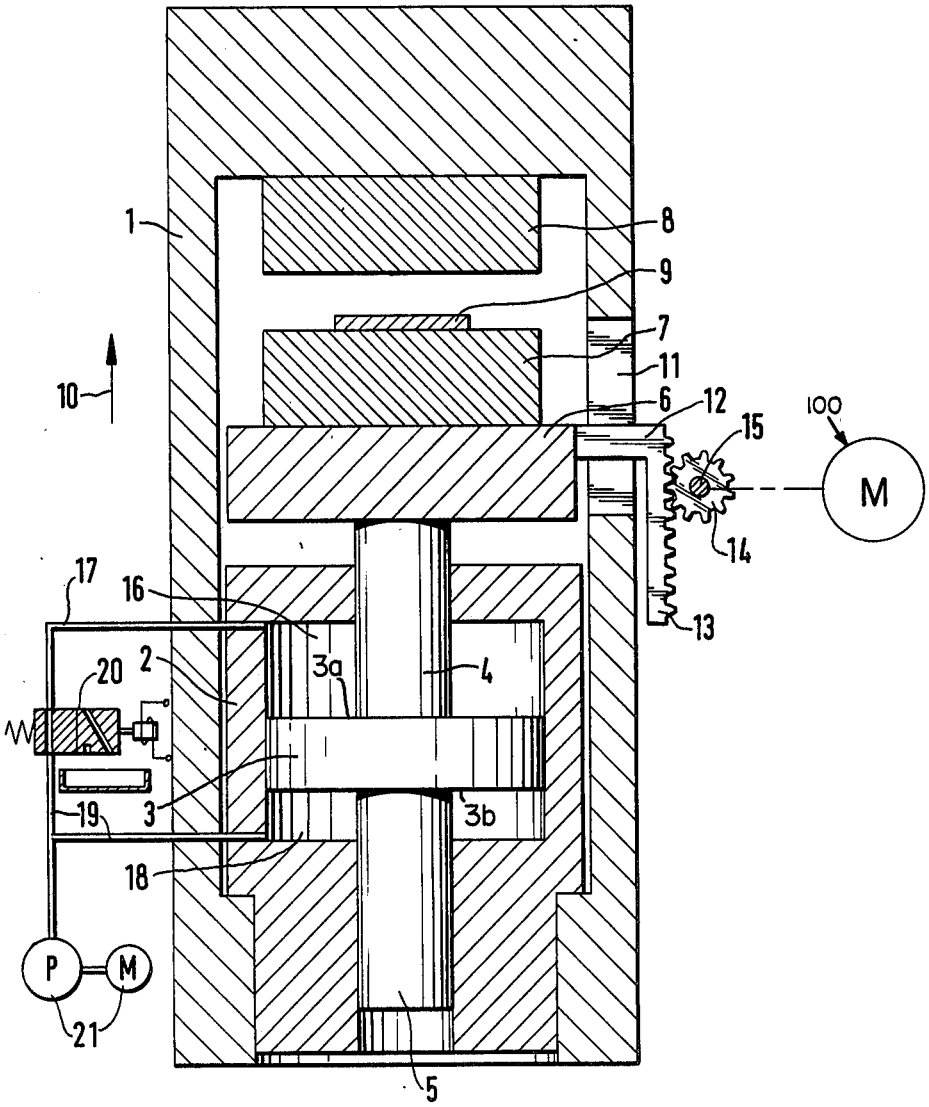
FIG. 1 is a partially schematic cross-sectional view of a first embodiment of a press arrangement in accordance with the present invention.

Referring now to the drawings wherein like reference numerals are used throughout the several views to designate like parts and, more particularly, to FIG. 1, a press includes a cylinder 2 which, together with a piston 3 movable therein, forms a cylinder piston unit. The cylinder 2 is fastened in a press frame 1 with a piston rod being operatively connected with the piston 3 and being sealingly guided in two end walls of the cylinder 2. The piston rod includes an upper portion 4 which passes through a top end wall of the cylinder 2 and is fastened to a press ram 6 which is guided for vertical movement in the press frame 1, while the lower portion 5 of the piston rod is guided in a bore provided in a lower end wall of the cylinder 2. A bottom tool 7 is fastened or secured on an upper face of the press ram 6 with an upper tool 8, which cooperates with the bottom tool 7 for processing of a workpiece 9 when the press ram 6 is moved in a working stroke direction 10, being fastened or secured on the press frame 1.

The upper portion 4 and lower portion 5 of the piston rod have the same diameter so that the operative or effective piston surfaces 3*a*, 3*b* of the piston 3, which are associated with a working stroke direction 10 (operative or effective surface 3*b*) and with an opposite direction (operative of effective piston surface 3*a*) are equal in size. A pressure medium line or pipe 17 is connected to a cylinder space 16 lying above the piston 3 with a pressure medium line or pipe 19 being connected to the cylinder space 18 lying beneath the piston 3. The pressure medium lines 17, 19 can be connected or placed in communication by way of a control valve 20 with the aid of which the connection between the pressure medium lines 17, 19 can be disconnected in such a manner that the pressure medium line 17 and the cylinder space 16 are relieved of pressure. A pressure medium source 21 is connected to the pressure medium line 19.

A rack 13 is fastened to the press ram 6 by means of a cantilever arm 12 passing through a slot-like opening 11 provided in the press frame 1 with a drivable pinion 14, mounted on a shaft 15 disposed on the press frame 1, meshing with the rack 13. The rack 13 and pinion 14, together with a suitable drive motor generally designated by the reference numeral 100 driving the shaft 15, form an auxiliary drive for the press ram 6.

Figure 2:
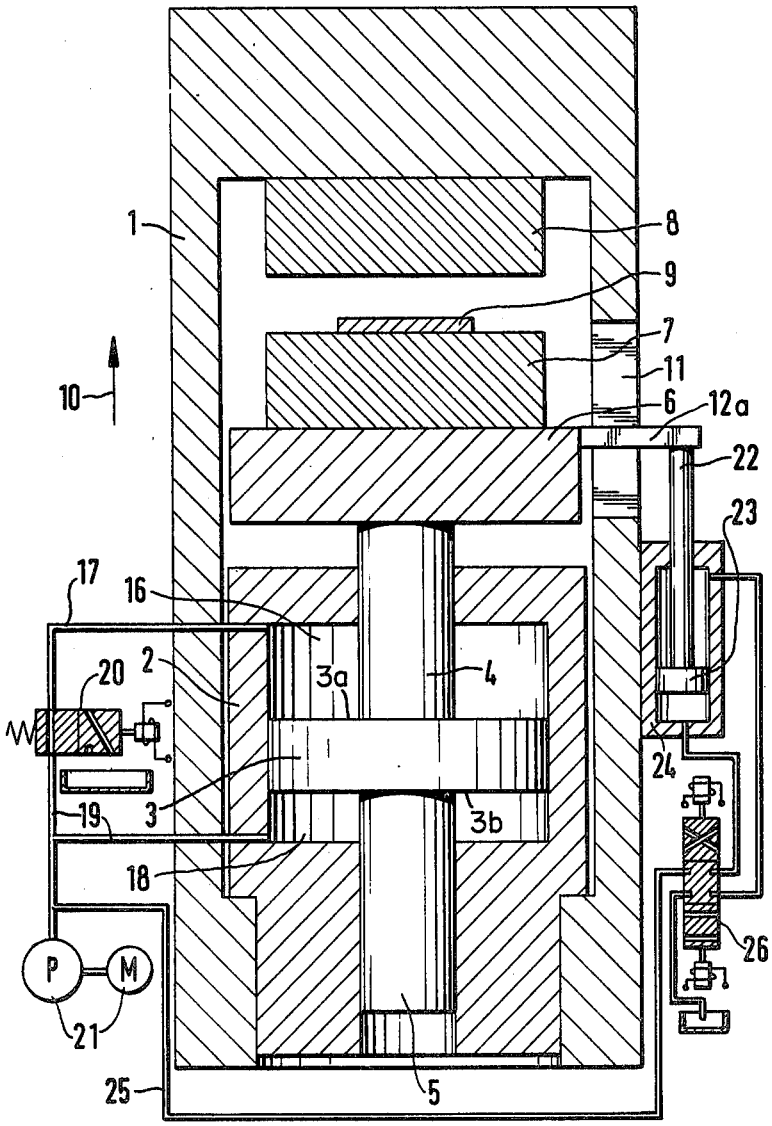
FIG. 2 is a partially schematic cross-sectional view of a second embodiment of a press arrangement in accordance with the present invention.

As shown in FIG. 2, a piston rod 22 may be fastened to the press ram 6 by means of a cantilever arm 12*a* which projects through a slot-like opening 11 in the press frame 1. The piston rod 22 carries or has mounted thereon a piston 23 guided in a cylinder 24 fastened on the press frame 1. By means of a branch pipe or pressure medium line 25 and a control valve 26, the cylinder piston unit 23, 24, forming an auxiliary drive, can be loaded or charged with a pressure medium from the pressure medium source 21, selectively, in a working stroke direction 10 and in an opposition direction by the auxiliary drive for the press ram 6.

In the arrangement of FIGS. 1 and 2, during an idle stroke of the press ram 6 produced by the auxilary drive in a working stroke direction 10, until the commencement of a processing of the workpiece 9, the cylinder spaces 16, 18 are connected together by way of the pressure medium lines 17, 19 and valve 20 so that the pressure medium held under pressure by the pressure medium source 21 can be forced from the upper cylinder space 16 into the lower cylinder space 18. At the commencement of a working stroke, the connection between the cylinder spaces 16 and 18 is interrupted by the valve 20 and the cylinder space 16 is relieved of pressure by way of the pressure medium line 17 so that the pressure of the pressure medium then acts on the piston 3 only in the lower cylinder space 18 and a working stroke is effected in the working stroke direction 10.

During the following stroke of the press ram 6 in an opposite direction, which is produced by the auxiliary drive, the cylinder spaces 16 and 18 are once again placed in communication by the pressure medium lines 17, 19 and the valve 20. During this time, the supply of pressure medium is replenished from the pressure medium source 21.

Figure 3:
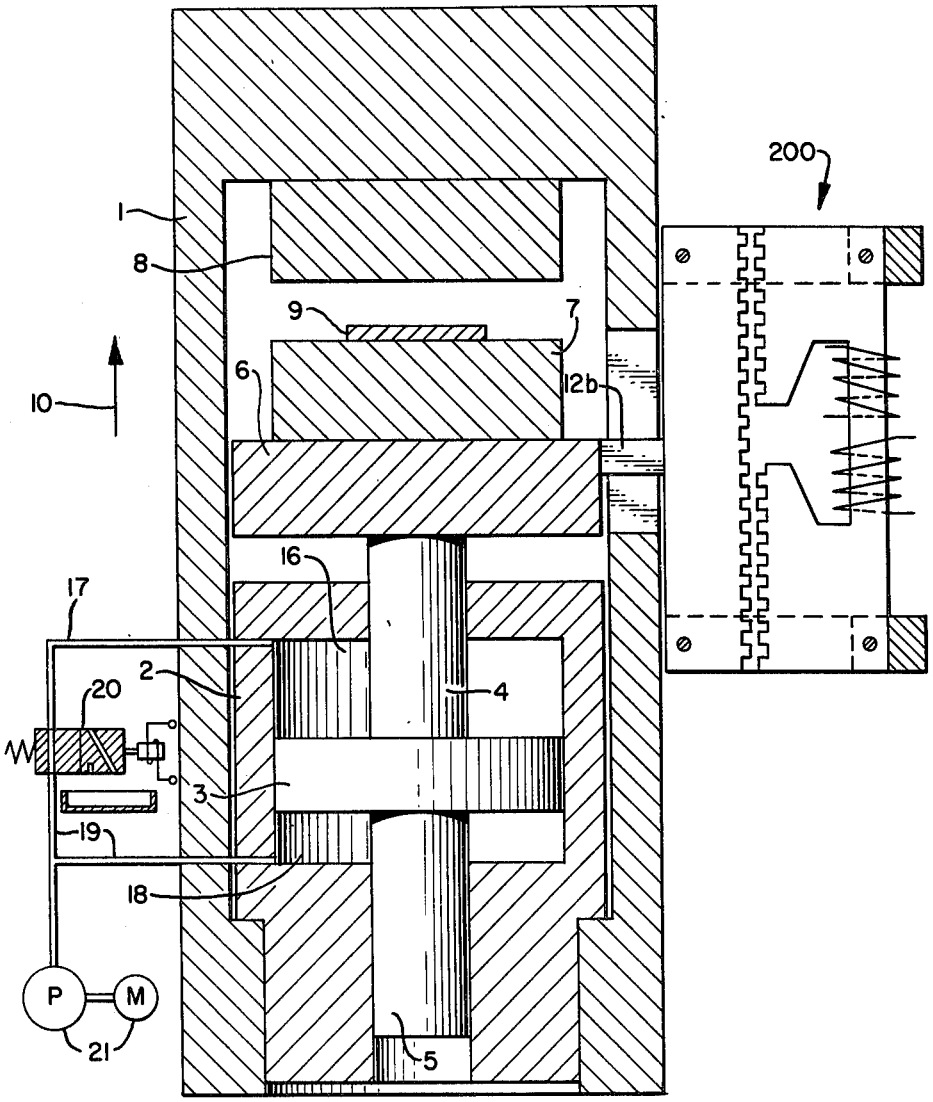
FIG. 3 is a partial schematic cross-sectional view of a third embodiment of a press arrangement in accordance with the present invention.

It is also possible, as shown in FIG. 3, to provide an electric linear motor generally designated by the reference numeral 200 of the type disclosed, for example, in U.S. Pat. No. 3,265,911 and British Pat. No. 1,183,730, to serve as an auxiliary drive for the press ram 6 with the electric linear motor 200 acting directly on the press ram 6 by way of a cantilever arm 12*b*.

While I have shown and described several embodiments in accordance with the present invention, it is understood that the same is not limited thereto, but is susceptible of numerous changes and modifications as known to one having ordinary skill in the art, and I therefore do not wish to be restricted to the details shown and described herein, but intend to cover all such changes and modifications as are encompassed by the scope of the appended claims.

I claim:

1. A press arrangement which includes a press ram selectively displaceable in a working stroke direction by at least one hydraulically actuated, double-acting cylinder piston means, and an auxiliary drive means for displacing the press ram in an idle stroke preceding a working stroke in a direction of the working stroke, characterized in that the auxiliary drive means bypasses the at least one cylinder piston means and acts upon the press ram, the cylinder piston means includes two effective piston surfaces, each associated with a pressure space means for accommodating a pressure medium, the two effective piston surfaces are of equal size, means are provided for communicating the pressure space means with each other and with a pressure medium source, and in that means are provided for controlling the communicating means such that a pressure medium from the pressure medium source is supplied to one of the pressure space means so as to displace the press ram in the working stroke direction while a supply of pressure medium to the other pressure space means is interrupted.

2. The arrangement of claim 1, characterized in that the controlling means includes a control valve arranged in the communicating means between the pressure space means.

3. The arrangement of claim 1, characterized in that the auxiliary drive means includes a toothed rack secured to the press ram and extending in a direction parallel to a direction of movement of the press ram, a pinion means meshing with said rack, and a drive means connected with said pinion means for selectively driving the pinion means in a forward and reverse direction of rotation.

4. The arrangement of claim 1, characterized in that the auxiliary drive means includes a linearly double-acting pressure medium drive acting on the press ram.

5. The arrangement of claim 4, characterized in that the double-acting pressure medium drive includes a double-acting cylinder piston unit having a piston connected to the press ram.

6. The arrangement of claim 1, characterized in that the auxiliary drive means includes an electric linear motor acting on the press ram.

* * * * *